US008739477B2

(12) United States Patent
Kaiser

(10) Patent No.: US 8,739,477 B2
(45) Date of Patent: Jun. 3, 2014

(54) MODULAR SAFETY SYSTEM

(75) Inventor: Benjamin J. Kaiser, Portland, OR (US)

(73) Assignee: CoreFirst, LLC, Portland, OR (US)

( * ) Notice: Subject to any disclaimer, the term of this patent is extended or adjusted under 35 U.S.C. 154(b) by 0 days.

(21) Appl. No.: 13/425,402

(22) Filed: Mar. 20, 2012

(65) Prior Publication Data

US 2013/0118097 A1 May 16, 2013

Related U.S. Application Data

(60) Provisional application No. 61/559,313, filed on Nov. 14, 2011.

(51) Int. Cl.
*E04B 1/98* (2006.01)
*E04H 9/02* (2006.01)

(52) U.S. Cl.
USPC ..... 52/167.1; 52/167.8; 52/79.1

(58) Field of Classification Search
CPC ..... E04B 1/3483; E04H 9/02
USPC ..... 52/79.1, 167.1, 167.6, 167.8, 167.9, 52/169.6, 393, 396.04
See application file for complete search history.

(56) References Cited

U.S. PATENT DOCUMENTS 3,418,768 A * 12/1968 Cardan ..... 52/167.1
4,744,941 A * 5/1988 Bacher et al. ..... 376/285
4,766,708 A * 8/1988 Sing ..... 52/167.8
5,462,141 A * 10/1995 Taylor ..... 188/280
5,727,663 A * 3/1998 Taylor ..... 188/378
5,794,389 A * 8/1998 Vysma ..... 52/169.6
5,862,639 A * 1/1999 Abou-Rached ..... 52/223.6
5,870,863 A * 2/1999 Taylor ..... 52/167.3
6,247,275 B1 * 6/2001 Taylor ..... 52/167.3
6,530,182 B2 * 3/2003 Fanucci et al. ..... 52/167.3
6,959,515 B1 * 11/2005 Beighton ..... 52/79.9
8,001,731 B2 * 8/2011 Huxel ..... 52/79.9
2001/0045069 A1 * 11/2001 Constantinou ..... 52/167.3
2008/0229682 A1 * 9/2008 Torsani ..... 52/167.1
2010/0058675 A1 * 3/2010 Simmons ..... 52/79.1
2010/0186317 A1 * 7/2010 Kirsten et al. ..... 52/167.8
2011/0214361 A1 * 9/2011 Ingjaldsdottir et al. ..... 52/79.1
2011/0252718 A1 * 10/2011 Kobayashi et al. ..... 52/79.1

* cited by examiner

*Primary Examiner* — Jeanette E Chapman
*Assistant Examiner* — James Buckle, Jr.
(74) *Attorney, Agent, or Firm* — Schwabe, Williamson & Wyatt

(57) ABSTRACT

Embodiments provide modular seismic safety systems and methods of providing safe zones and emergency equipment for use in public and private buildings. In various embodiments, the modular safety systems may include at least one safety module that may be installed in a pre-existing structure in order to provide a safety zone configured to withstand a seismic emergency. In various embodiments, the safety module may be configured to withstand the forces of an earthquake, and may be seismically isolated from the preexisting structure by an expansion joint. In some embodiments, a plurality of safety modules may be installed, and they may work together to form in internal bracing structure. Various embodiments also may include a freestanding safety capsule that contains safety equipment and that is exterior to the building. Also disclosed are methods of providing a cost-effective modular safety system for use in a school or other public building.

27 Claims, 3 Drawing Sheets scale 1/2"=1'

School Floor Plan w/
CoreFirst Seismic Structures

MODULAR SAFETY SYSTEM

CROSS REFERENCE TO RELATED APPLICATIONS

The present application claims priority to U.S. Provisional Patent Application No. 61/559,313, filed Nov. 14, 2011, entitled "MODULAR SAFETY SYSTEM," the disclosure of which is hereby incorporated by reference in its entirety.

TECHNICAL FIELD

Embodiments herein relate to the field of building safety, and, more specifically, to modular safety systems and methods of providing safe zones and emergency equipment for use in schools and other public and private buildings in the event of a catastrophic occurrence such as an earthquake.

BACKGROUND

There is no way of precisely predicting when or where the next seismic event will occur, or when an earthquake will generate an offshore shift in tectonic plates that will produce a tsunami. Recent natural disasters of these types have had devastating effects around the world, leaving governments and the private sector scrambling to adequately prepare for similar future events.

Seismic maps identify areas of the United States—and the world—that are more and less likely to experience an earthquake. For example, due to the location of fault lines, the West Coast of the United States has been given a high hazard rating, whereas the East Coast is rated as the least hazardous. In many areas, these hazard classifications dictate whether municipalities must adhere to strict construction requirements that bolster a building's ability to withstand a seismic event. While the entire West Coast has been requiring new and retrofitted buildings to abide by these seismic codes for over 30 years, recent earthquakes have occurred in areas previously designated "non-hazard" areas, raising the possibility that "non-hazard" areas will have to abide by strict seismic upgrading codes, as well. Although the intent behind seismic upgrade requirements is extremely high value (to preserve life and property), the cost of these upgrades is immense and often implausible to fund.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
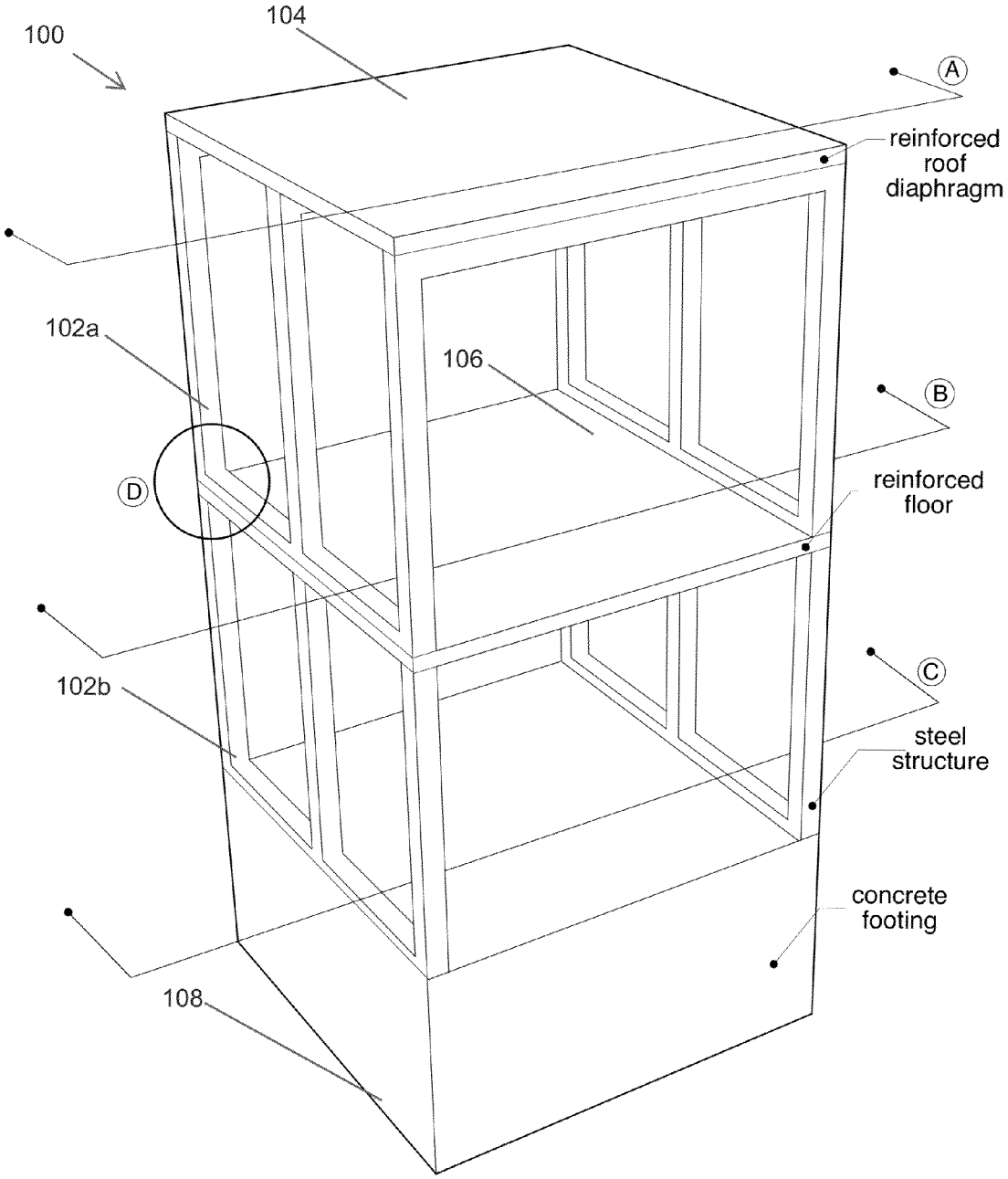
FIG. 1 is a perspective view of one example of a safety module for use in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Disclosed in various embodiments are systems and methods for the seismic retrofitting of buildings. Seismic retrofitting refers to the modification of existing structures to make them more resistant to seismic activity, ground motion, and/or soil failure due to earthquakes. Prior to the introduction of modern seismic codes, many structures were designed without adequate detailing and reinforcement for seismic protection. Although the retrofitting systems and methods described herein are described as seismic upgrades, they also may be useful for protection from other natural hazards, such as hurricanes, cyclones, tornadoes, tsunamis, and severe winds from storms, as well as other man-made disasters such as shootings and other acts of violence.

Embodiments herein provide modular safety systems that may be installed in existing buildings in multiple phases, which may allow flexibility in the scope and timing of the project. In various embodiments, the first phase of the modular safety system may include at least one safety module that may be installed in a building, such as a commercial structure, a public building such as a school, or a home. In various embodiments, each safety module may be sufficiently strong to withstand the forces of an earthquake, tornado, and/or other disaster, and it may provide a safe place within a larger building for building occupants to gather during an earthquake, storm, or other event. In various embodiments, a desired number of safety modules may be used, allowing the size of the retrofitting project to be matched to the needs of the individual structure, its use, and/or the budgetary constraints of the project. Thus, the first phase of the modular safety system may provide an affordable solution for disaster preparedness, without incurring the expense of a full seismic upgrade for an entire building, which may include low-priority areas, such as empty basements, storage rooms, vacant wings, etc.

In various embodiments, the safety modules may be strategically located in natural gathering points, such as hallways and/or entryways, as well as in or near lobbies, auditoriums, gymnasiums, cafeterias, and the like. In some embodiments, once one or more safety modules have been installed, specific evacuation training may be carried out so that occupants may practice moving in and out of the safety modules in an emergency. In some embodiments, the safety modules may be delineated with paint, special lighting, or other indicia to make them easy to locate in an emergency. In various embodiments, the safety modules may be installed in a building very quickly and with minimal disruption. For example, they may be installed in a school building during the summer months, minimizing disruption to students and teachers during the school year.

In various embodiments, the safety modules may be seismically isolated from the rest of the building structure, for example with one or more flexible expansion joints. In some embodiments, these flexible expansion joints may include elastomeric elements that may allow for movement of the safety module relative to the rest of the structure. In particular embodiments, the safety module may be seismically isolated from the surrounding structures by an elastomeric gasket, such as a twelve-inch rubber gasket. Many suitable flexible expansion joints are known to those of skill in the art. In various embodiments, it is this expansion joint (the width of which is determined by the rigidity or other properties of the adjoining structure(s)) that enables the safety module to be placed within older, pre-existing structures. For example, in various embodiments, due to the differing moments of previous construction techniques (brick, concrete, steel, CMU, or a combination thereof) as compared to the newly installed safety module, the expansion joint allows the older structure and the new safety module to move at different moments without the risk of one damaging one another in a seismic or other event.

In various embodiments, emergency service materials may be stored in the safety modules, such as telecommunications equipment, computers, medications and materials to help those who have health issues (e.g., defibrillators, revival paddles, inoculants, first aid kits), food and water, and anything else one might need in such an emergency. In various embodiments, locating one or more of the safety modules in a central location of the building may result in a far safer disaster plan than a standard exterior evacuation plan, as the safety modules may be accessed much more quickly by building occupants than a typical run to an outdoor meeting place. Additionally, locating the safety modules indoors may be safer than a typical outdoor evacuation plan in the case of weather-related events such as tornadoes and hurricanes. In some embodiments, the safety and/or communications equipment may be maintained by a third party, such as the safety module supplier.

As described above, in some embodiments, the safety modules may serve as the first phase of a multiple phase seismic update of a building. For example, in various embodiments, the safety modules may be designed to function as a safe area (e.g., for waiting out a disaster such as an earthquake), and in other embodiments, the safety modules may serve as both a safe area as well as being integral structural components in a larger system should additional seismic upgrading be desired in the future. For example, in some embodiments, one or more safety modules may act as lateral bracing components for a more comprehensive building-wide upgrade.

For example, in some embodiments, the safety module may be designed solely to protect those that are in it during an event, and not to accommodate future lateral loads being placed on it. This example may provide an inexpensive approach because less robust footings, steel, and other components and structures may be used. In other embodiments, the safety module may be designed and constructed to accommodate future lateral loads being tied into it, for instance if a full or partial seismic upgrade is undertaken at some point in the future. In these embodiments, the safety modules may include footings, steel, and other components and structures that are designed to accommodate the forces of the existing building's lateral loads, should they be tied into in the future if a partial or complete seismic retrofit is desired. In various embodiments, lateral loads may be tied into one or more safety modules at some point in the future, for instance via the use of drag struts or other engineering methods. In various embodiments, such engineering methods may be used for transferring the lateral forces of the existing structure(s) into the safety module's more robust, laterally stable structure(s), in the event of a seismic, or other natural event.

Thus, in various embodiments, when funding is not available for a full building-wide seismic upgrade, the first phase of the modular systems described herein may be deployed to protect the building occupants until such time as a full seismic upgrade may be completed. Additionally, the expense of installing phase one of the system will not go to waste, as the safety modules form an integral part of the full system, in accordance with various embodiments.

In various embodiments, phase two of the multiple phase system may include installing additional safety modules in strategic locations, such as in a vertical stack on adjacent floors, and/or periodically spaced throughout a building. In various embodiments, such vertical stacks or periodically spaced safety modules may be secured to one another to form an internal bracing system. In various embodiments, steel plates or other reinforcements may be used to reinforce floor and/or ceiling structures, and these also may be secured to the plurality of safety modules. In some embodiments, the safety modules also may be coupled to cement piers positioned in the earth or rock beneath the structure, and/or to reinforcing structures such as columns and/or buttresses located external to the building. In some embodiments, building exits also may be reinforced, for example using parapet bracing and the like, both to allow occupants to exit the building safely, and to allow first responders to safely enter the building.

In various embodiments, the safety modules may rest on their own foundations and may be configured to be seismically independent of the existing structures. In one specific, non-limiting example, if additional seismic upgrading is desired and funding is available, a roof diaphragm may be tied to one or more safety modules, which in various embodiments, would entail installing plywood or another suitable material on the entire roof, enabling the roof to act as a singular plane. In various embodiments, such a roof diaphragm would then be better able to resist lateral forces. In another specific, non-limiting example, in addition to or in lieu of the roof diaphragm, one or more floor diaphragms may be tied into one or more safety modules. In yet another specific, non-limiting example, in addition to or in lieu of installing a roof and/or floor diaphragm, one or more vertical surfaces may be strengthened via the use of strongbacks and the like to attend to unreinforced masonry aspects of the walls.

In various embodiments, the system also may include a separate exterior safety capsule that may be used alone or in conjunction with the safety modules described herein. In some embodiments, the safety capsule may be an attached or freestanding earthquake and waterproof structure that may house equipment and supplies for aiding and protecting people after a sizeable event. For example, in various embodiments, if local or national communications systems are non-operational, and/or if hospitals have been compromised, the safety capsules may be accessed not only by building occupants, but also by other members of the community. In some embodiments, the safety capsules may be solar powered, with or without battery backup, and may include communications equipment such as HAM radios, a robust supply of first aid equipment, and/or water filtration or purification equipment. In various embodiments, the safety capsules also may contain information about the building occupants, such as a roster of children's names, family members, and their contact information, in the case of a school. In various embodiments, this information may be used by first responders or by other members of the community after a disaster.

In some embodiments, the safety capsules may be constructed of watertight, hardened steel, and may serve as beacons for a community both before and after an event. In some embodiments, the safety capsules also may serve as local learning centers for disaster preparedness training. For example, in some embodiments, the safety capsules may serve as designated community disaster meeting areas, as well as training centers for CPR, first aid, and/or HAM radio operation.

Various embodiments also include methods of making cost-effective seismic upgrades to a building. In various embodiments, the safety modules and/or safety capsules described above may be manufactured off-site by a manufacturer and installed in a building in need of upgrading by an installer. In some embodiments, the installer and the manufacturer may be the same entity. In some embodiments, rather than purchasing and paying for the seismic upgrades up front, a third party, such as the manufacturer, installer, and/or other third party may lease the modular seismic upgrade system to the building owner/manages, thus avoiding a large up-front cost to the building owner/manager. In some embodiments, the lessor may also finance the materials and/or installation costs. In some embodiments, the terms of the lease may include maintenance of the modules and/or capsules, for instance so that the communications equipment, batteries, safety equipment, first aid equipment, and/or training and learning materials are maintained in working order at all times. Thus, in various embodiments, school systems and other public and private institutions may be able to meet current seismic codes without significant costs up front. In some embodiments, the lease may be paid through operational funds.

FIG. 1 is a perspective view of one example of a safety module for use in accordance with various embodiments. In the illustrated example, the system 100 includes two safety modules 102*a*, 102*b* positioned in a stack on adjacent floors. In this embodiment, both safety modules 102*a*, 102*b* may be made of steel, although other suitable materials may be substituted, such as cast in place concrete, shotcrete, and engineered lumber. In the illustrated example, a reinforced roof diaphragm 104 may sit on top of the upper safety module 102*a*. In some embodiments, reinforced roof diaphragm 104 may include a steel plate, however in other examples, other suitable materials may be used, such as cast in place concrete, shotcrete, engineered lumber, and plywood. Additionally, in the illustrated example, a reinforced floor diaphragm 106 may sit between the upper safety module 102*a* and the lower safety module 102*b*. A concrete footing 108 may support lower safety module, as in the illustrated example, although in other examples, lower safety module 102*b* may be supported by other structures, such as concrete pillars or piers. In various embodiments, system 100 may be used in any building having one or more stories or floors, for example, at least one, at least two, at least three, at least four, at least five, at least six, at least seven, at least eight, at least nine, or at least ten stories. In particular embodiments, system 100 may be used in buildings having five or fewer stories.

Figure 2:
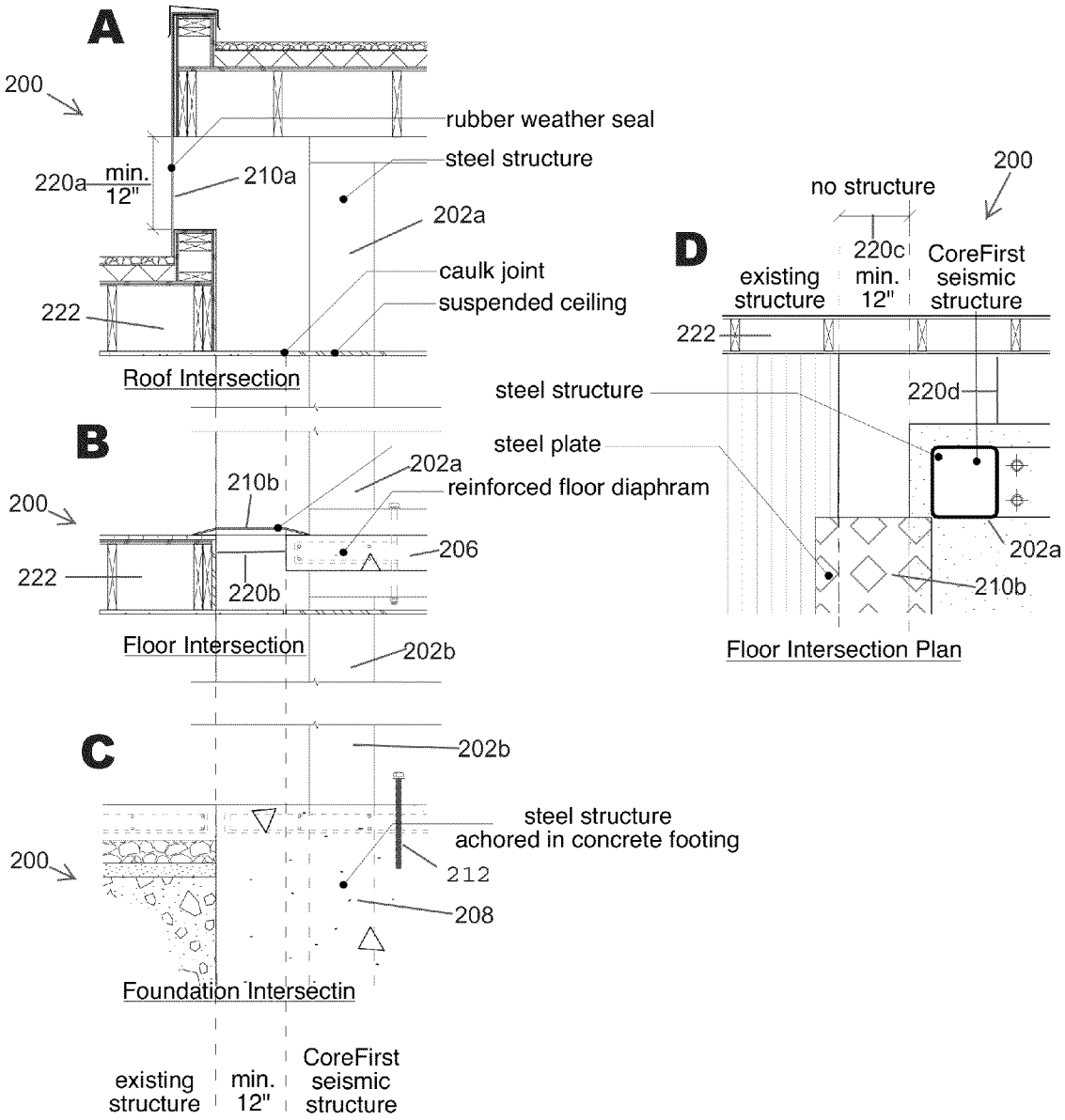
FIGS. 2A-2D illustrate sectional views of the intersections between the safety module and the reinforced roof diagram (FIG. 2A), between the safety module and the reinforced floor diaphragm (FIG. 2B), between the safety module and the foundation (FIG. 2C), and a cross-sectional view of the intersection of the safety module, the reinforced floor diaphragm, and the existing structure.

FIGS. 2A-2D illustrate sectional views of the intersections between the safety module and the reinforced roof diagram (FIG. 2A), between the safety module and the reinforced floor diaphragm (FIG. 2B), between the safety module and the foundation (FIG. 2C), and a cross-sectional view of the intersection of the safety module, the reinforced floor diaphragm, and the existing structure, in accordance with various embodiments. Turning now to FIG. 2A, in various embodiments, in modular system 200, the upper safety module 202*a* may be separated from the existing building structure 222 by an expansion joint 220*a* having a width of at least 12 inches. In some embodiments, expansion joint 220*a* may be spanned by a rubber weather seal 210*a*.

Turning now to FIG. 2B, in some embodiments, a reinforced floor diaphragm 206 may be positioned between upper safety module 102*a* and lower safety module 102*b* in modular safety system 200. In the illustrated example, upper safety module 102*a*, lower safety module 102*b*, and reinforced floor diaphragm 206 all may be separated from the existing building structure 222 by an expansion joint 220*b* having a width that is determined by the size, mass, and/or rigidity of adjoining structures. In one specific, non-limiting example, the expansion joint may be at least eight, ten, twelve, fourteen, or more inches wide. In the illustrated embodiment, expansion joint 220*b* may be spanned by a steel plate 210*b*.

As illustrated in FIG. 2C, in modular safety system 200, lower safety module 202*b* may be anchored to a concrete footing 208 via a connector 212 such as rebar.

As illustrated in FIG. 2D, in some embodiments of the modular safety system 200, the upper safety module 202*a* may be separated on all sides from the existing structure 222 by an expansion joint 220*c*, 220*d* having a minimum width. In some embodiments, the minimum width may be determined by one of skill in the art, such as an engineer. In some specific, non-limiting examples, the minimum width may be at least 10, at least 11, at least 12, at least 13, or at least 14 inches, which dimension may vary depending on the characteristics of the surrounding structure and the judgment of the engineer. In the illustrated example, the minimum width is 12 inches, but this dimension is included for illustration purposes only and is not intended to be construed as limiting. As illustrated, in some embodiments, expansion joint 220*c* may be spanned by a steel plate 210*b*.

Figure 3:
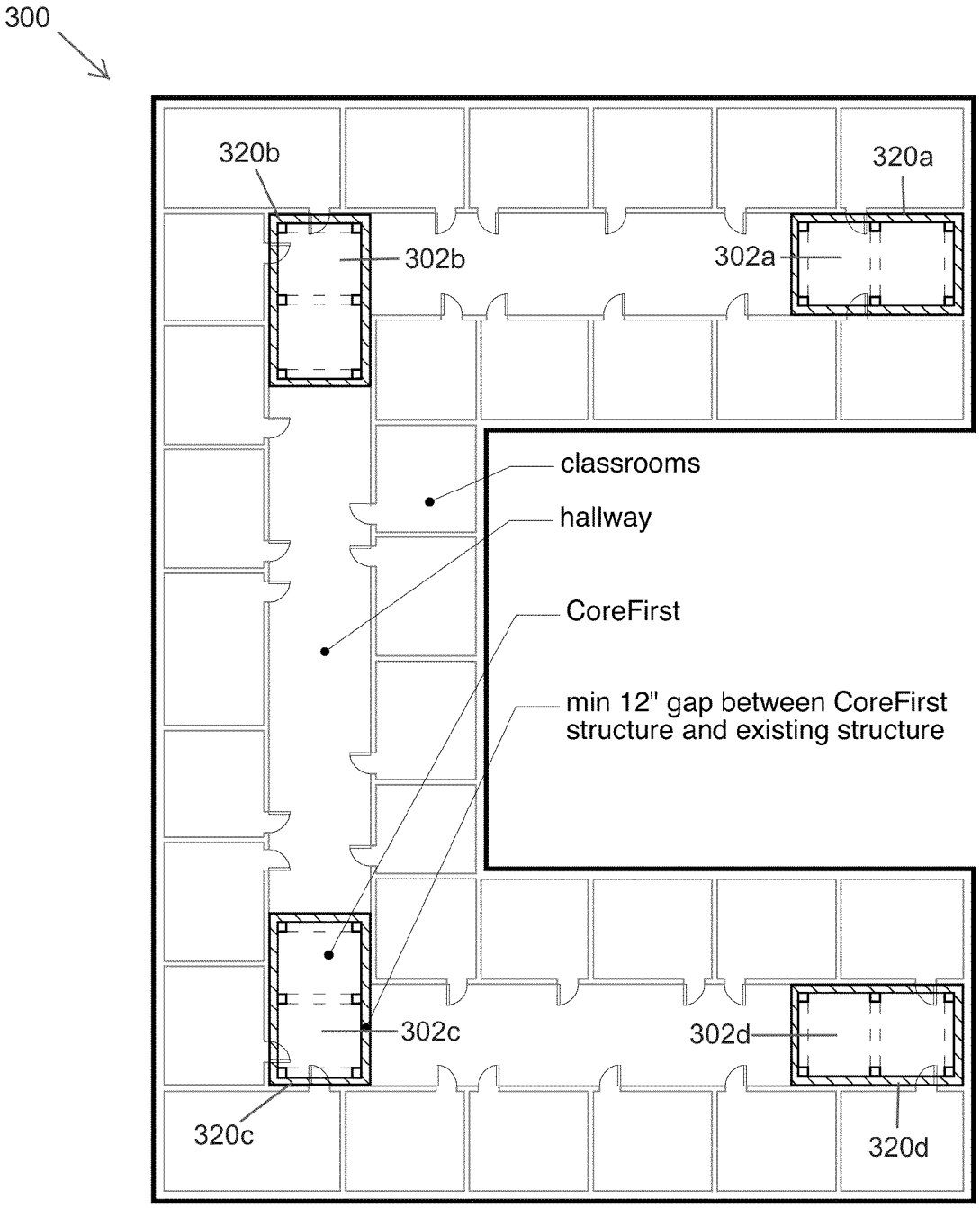
FIG. 3 illustrates a floor plan of a building wherein several safety modules have been installed, all in accordance with various embodiments.

FIG. 3 illustrates a floor plan of a building wherein several safety modules have been installed, all in accordance with various embodiments. As illustrated, modular safety system 300 may include several safety modules 302*a*, 302*b*, 302*c*, and 302*d*, each of which is fully surrounded by an expansion joint 320*a*, 320*b*, 320*c*, and 320*d* that allows for a separation of a minimum width, such as at least 10, 12, or 14 or more inches between the existing structure 322 and each safety module each safety module 302*a*, 302*b*, 302*c*, and 302*d*. In various embodiments, the minimum width required may be determined, for example, by the size, mass, and/or rigidity of adjoining structures.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A modular safety system comprising first and second safety modules for installation in and seismic retrofitting of a pre-existing, seismically unsafe structure, wherein each safety module comprises:

a frame comprising:

a first vertical side support frame member;

a second vertical side support frame member spaced apart from the first vertical side support frame member;

a plurality of horizontal beams coupled to, disposed on top of, and spanning a distance between the first and second vertical side support frame members; and a reinforced horizontal ceiling or floor diaphragm spanning the distance between the first and second vertical side support frame members;

wherein each safety module is configured to withstand the forces of a seismic event, wherein the first safety module is coupled directly to the second safety module, and wherein each safety module is seismically isolated from the structure by a flexible expansion joint.

2. The modular safety system of claim 1, wherein at least one of the first and second safety modules is coupled directly to a footing, and wherein the first and second safety modules are configured to provide an internal bracing system within the pre-existing structure.

3. The modular safety system of claim 1, wherein the expansion joint comprises an elastomeric material.

4. The modular safety system of claim 3, wherein the elastomeric material comprises a rubber gasket.

5. The modular safety system of claim 1, wherein the first and second safety modules are configured to be stacked on adjacent floors.

6. The modular safety system of claim 1, wherein the modular safety system further comprises one or more external bracing elements, and wherein the first and second safety modules are configured to couple to one or more external bracing elements.

7. The modular safety system of claim 6, wherein the one or more external bracing elements comprise a footing, a buttress, or a pillar.

8. The modular safety system of claim 2, wherein the footing is a concrete footing.

9. The modular safety system of claim 1, wherein the expansion joint comprises a first side and a second side, and wherein the expansion joint is fixed to the structure or the safely module at only the first side.

10. The modular safety system of claim 1, wherein the expansion joint comprises a steel plate that rests on top of the floor diaphragm.

11. The modular safety system of claim 1, wherein the expansion joint spans a joint between the floor diaphragm and a feature of the structure, and wherein the floor diaphragm and the feature are in substantially the same horizontal plane.

12. The modular safety system of claim 1, wherein the system further comprises an attached or freestanding exterior safety capsule, wherein the exterior safety capsule is configured to be watertight and to withstand the forces of a seismic or weather event, and wherein the exterior safety capsule comprises emergency equipment.

13. The modular safety system of claim 12, wherein the emergency equipment comprises communications equipment, first aid equipment, emergency food, emergency water, and/or emergency water filtration or purification equipment.

14. A method of providing seismic retrofitting to a preexisting structure, the method comprising:

installing a safety module in the preexisting structure, wherein the safety module comprises:

a frame comprising;

a first vertical side support frame member;

a second vertical side support frame member spaced apart from the first vertical side support frame member;

a horizontal beam coupled to, disposed on top of, and spanning a distance between the first and second vertical side support frame members; and a reinforced horizontal ceiling or floor diaphragm spanning the distance between the first and second vertical side support frame members;

coupling the safety module directly to a footing, wherein the safety module is configured to withstand the forces of a seismic event, and wherein the safety module is seismically isolated from the preexisting structure by a flexible expansion joint.

15. The method of claim 14, wherein the method comprises installing a plurality of safety modules, and wherein the method further comprises coupling the plurality of safety modules to one another to provide an internal bracing system within the pre-existing structure.

16. The method of claim 14, wherein the method further comprises coupling the safety module to one or more external bracing elements.

17. The method of claim 14, wherein the method further comprises installing a second safety module and coupling both safety modules directly to one another.

18. The method of claim 15, wherein the method further comprises installing an attached or freestanding exterior safety capsule, wherein the exterior safety capsule is configured to be watertight and to withstand the forces of a seismic or weather event, and wherein the exterior safety capsule comprises emergency equipment.

19. The method of claim 18, wherein the method further comprises stocking the one or more safety modules or safety capsules with communications equipment, first aid equipment, emergency food, emergency water, and/or emergency water filtration or purification equipment.

20. A method of providing low-cost seismic retrofitting to a preexisting structure lacking sufficient seismically protective features, wherein the method comprises:

installing one or more safety modules in the preexisting structure, wherein the one or more safety modules each comprises:

a frame comprising:

a first vertical side support frame member;

a second vertical side support frame member spaced apart from the first vertical side support frame member;

a plurality of horizontal beams coupled to, disposed on top of, and spanning a distance between the first and second vertical side support frame members; and a reinforced horizontal floor or ceiling diaphragm spanning the distance between the first and second vertical side support frame members; wherein the one or more safety modules are configured to withstand the forces of a seismic event;

coupling at least one of the safety modules directly to a footing; and leasing the one or more safety modules to the owner of the preexisting structure.

21. The method of claim 20, wherein the method further comprises stocking the one or more safety modules with communications equipment, first aid equipment, emergency food, emergency water, and/or emergency water filtration or purification equipment.

22. A modular safety system comprising:

a safety module for installation in and seismic retrofitting of a pre-existing structure, wherein the safety module comprises a frame comprising:

a first vertical side support frame member;

a second vertical side support frame member spaced apart from the first vertical side support frame member;

a plurality of horizontal beams coupled to, disposed on top of, and spanning a distance between the first and second vertical side support frame members; and a reinforced horizontal ceiling or floor diaphragm spanning the distance between the first and second vertical side support frame members;

wherein the safety module is configured to withstand the forces of a seismic event, and wherein the safety module is coupled directly to a footing.

23. The modular safety system of claim 22, wherein the first and second vertical side support members couple directly to the footing.

24. A modular safety system comprising:

a safety module for installation in and seismic retrofitting of a pre-existing structure, wherein the safety module comprises a frame comprising:

a first vertical side support frame member;

a second vertical side support frame member spaced apart from the first vertical side support frame member;

a plurality of horizontal beams coupled to, disposed on top of, and spanning a distance between the first and second vertical side support frame members; and a reinforced horizontal floor diaphragm spanning the distance between the first and second vertical side support frame members;

wherein the safety module is configured to withstand the forces of a seismic event, and wherein the safety module is seismically isolated from the structure by a flexible expansion joint, wherein the expansion joint comprises a first side and a second side, and wherein the expansion joint is fixed to the safety module or the structure at only the first side of the joint.

25. The modular safety system of claim 24, wherein the expansion joint spans a joint between the floor diaphragm and a feature of the structure, and wherein the floor diaphragm and the feature are in substantially the same horizontal plane.

26. The modular safety system of claim 24, wherein the expansion joint comprises a steel plate.

27. The modular safety system of claim 26, wherein the steel plate sits directly on top of the floor diaphragm.

* * * * *